US008863960B2

(12) United States Patent
Chaganos

(10) Patent No.: US 8,863,960 B2
(45) Date of Patent: Oct. 21, 2014

(54) UTENSIL SORTING APPARATUS

(71) Applicant: Greg Chaganos, Chicago, IL (US)

(72) Inventor: Greg Chaganos, Chicago, IL (US)

( * ) Notice: Subject to any disclaimer, the term of this patent is extended or adjusted under 35 U.S.C. 154(b) by 0 days.

(21) Appl. No.: 13/969,480

(22) Filed: Aug. 16, 2013

(65) Prior Publication Data

US 2014/0054205 A1 Feb. 27, 2014

Related U.S. Application Data

(63) Continuation-in-part of application No. 13/036,468, filed on Feb. 28, 2011, now Pat. No. 8,534,466.

(60) Provisional application No. 61/308,989, filed on Feb. 28, 2010.

(51) Int. Cl.

| | |
|---|---|
| ***B07C 5/00*** | (2006.01) |
| ***B07C 99/00*** | (2009.01) |
| ***B07C 5/34*** | (2006.01) |
| ***B07C 5/344*** | (2006.01) |

(52) U.S. Cl.

CPC ... *B07C 5/00* (2013.01); *B07C 9/00* (2013.01); *B07C 5/34* (2013.01); *B07C 5/344* (2013.01); *Y10S 209/926* (2013.01)

USPC ..... 209/509; 209/606; 209/617; 209/659; 209/926

(58) Field of Classification Search

USPC ..... 209/509, 552, 606, 617, 659, 680, 926; 235/385

See application file for complete search history.

(56) References Cited

U.S. PATENT DOCUMENTS

| | | | | |
|---|---|---|---|---|
| 3,938,533 | A * | 2/1976 | Richard | 134/63 |
| 4,954,250 | A * | 9/1990 | Weihe et al. | 209/629 |
| 5,237,801 | A * | 8/1993 | Hillam et al. | 53/446 |
| 5,996,809 | A * | 12/1999 | Chiasson | 209/636 |
| 6,530,735 | B1 * | 3/2003 | Trammell | 414/275 |
| 6,889,813 | B1 * | 5/2005 | Trammell et al. | 198/346.3 |

FOREIGN PATENT DOCUMENTS

| | | | | |
|---|---|---|---|---|
| WO | WO 2009076452 | A2 * | 6/2009 | A61L 2/24 |

* cited by examiner

*Primary Examiner* — Terrell Matthews
(74) *Attorney, Agent, or Firm* — Atanu Das; Techlaw LLP

(57) ABSTRACT

An apparatus and method are provided for managing (e.g. sorting, orienting, arranging, and stacking, etc.) one or more utensils; the utensils having a first and second end that define a longitudinal axis. The utensil sorting apparatus comprises of a plurality of arms to which a mechanism for locating a utensil, one or mechanisms for identifying a utensil, a device for orienting a utensil, and a device for grasping a utensil are attached. The grasping mechanism is used to transport a utensil to various steps used in a sorting process with a final step being to place the utensil in a designated bin, or compartment. The utensils placed in a compartment are oriented such that the first end of each utensil is at the same end of a wall of the compartment. The apparatus can also be used to arrange and stack utensils in preparation for secondary operations.

15 Claims, 19 Drawing Sheets

UTENSIL SORTING APPARATUS

CROSS-REFERENCE TO RELATED APPLICATIONS

The present application is a continuation-in-part of, and claims priority under the laws and rules of the United States, including 35 USC §120, to U.S. patent application Ser. No. 13/036,468 filed on Feb. 28, 2011 which in turn claims priority under the laws and rules of the United States, including 35 USC §120, to US Provisional Patent Application No. 61/308,989 filed on Feb. 28, 2010. The contents of U.S. patent application Ser. No. 13/036,468 and U.S. Provisional Patent Application No. 61/308,989 are herein incorporated by reference in their entireties.

BACKGROUND

The present disclosure relates to an apparatus for finding, identifying, sorting, arranging, and stacking or otherwise managing utensils, such as forks and spoons. More specifically, the present disclosure relates to a utensil sorting device that can continually receive unsorted utensils while simultaneously sorting one more of the utensils, then identify and orient the utensil, followed by placing the utensil in a designated area. The apparatus can also be used for arranging and stacking utensils for secondary operations such as wrapping utensils in a napkin.

In industries such as restaurants, hotels, casinos, banquet halls, caters, hospitals, etc., a business may serve several hundred to several thousand guests per day. Each of these guests may use three or more utensils during their meal. Moreover, some businesses may serve 3 meals per day. This creates a need for the aforementioned businesses to clean thousands of utensils every day; the cleaning process involves soaking, sorting, and usually two washes. Furthermore, in some business, the utensils are wrapped in a napkin after they are cleaned, creating even more work that needs to be completed.

Typically these processes are done using unskilled labor. However, both processes are time consuming and often are required to be completed at times when the highest numbers of customers are at the facility. This can create a timing issue that forces a business to employ additional staff at the peak times, as well as keep staff at the facility for a longer time before or after a shift. Furthermore, due to the repetitive nature of the tasks, the employees can be at risk of developing repetitive stress injuries.

It is desirable to provide systems, apparatuses, devices, and methods that can complete as much as possible of the cleaning, sorting and wrapping processes with minimal human involvement. Furthermore, the device should be simple enough for an unskilled employee to operate, fast enough to sort, clean, and organize at the same rate a person can, as quiet as possible, and as compact as possible to minimize the amount of space required for the device at the business since space is typically limited.

Several devices have been developed for sorting utensils; most of these involve sizing apertures in the devices to allow only certain size items to pass through. Other systems may also employ a conveyor and/or vibration element to aid in separating the pieces from one another. These devices are limited in their ability because they require utensils to fit into a particularly sized aperture. Also, different utensils can have the same length, thus making the method of differentiating the utensils inadequate.

Some of the disadvantages to these systems include size, noise level, amount of human involvement, ability to integrate with existing equipment, and limitations that require utensils to be a specific size, as well as to have different lengths for each. Additionally, a number of the devices do not orient the utensils, which can be a time consuming, but necessary step in the utensil cleaning process. Moreover, several of the devices are not able to sort more than a single utensil at a time. Furthermore, not all of the devices are designed to fit in with existing standard restaurant equipment, such as tables, bus bin carts, etc.

Next, secondary operations, such as wrapping utensils in a napkin, require a user to orient the utensils before feeding them into a machine. Some systems require the user to put the utensils in a bin, while others have specially designed trays that the utensils can be washed in. Both of these systems require some level of human involvement to arrange the utensils.

For these reasons, it would be advantageous to create systems, apparatuses, and devices that are compact, reliable, sanitary, fast, and requires minimal human interaction to sort, arrange, or otherwise manage utensils. Such systems, apparatuses, devices, and methods would be able to sort, orient, soak, and set up the utensils for secondary operations such as utensil wrapping.

In some embodiments, ware can be inserted or placed into the unsorted tray in a random fashion. In certain instances, the random placement of ware allows pieces ware to be pushed up against the sides of the unsorted tray (i.e. perpendicular to the floor of the tray). Such pieces of ware are more difficult to grab, but are still needed to be sorted as well as the pieces in the center of the tray (i.e. lying parallel to the floor of the tray). For this reason, it may be helpful to have a mechanism to pull the ware from the side of the tray so that it is easier to grab.

Thus, the ware can be placed in a tray such that it is parallel or perpendicular to the bottom of a tray. The decision on which method to use depends on the step in the wash cycle of the ware. For this reason, it may be beneficial to be able to orient the ware in both directions; i.e. perpendicular to the bottom (floor) of the tray or parallel to the bottom (floor) of the tray.

During a work shift at a dining establishment, an employee may need to choose between tasks during busy hours. One task that may be scheduled to be performed at a later time is sorting ware. For this reason, it may be beneficial to have a way to see how much ware is in the sorted bins so that a user can decide when to clean the ware.

The sorting apparatus may be setup on a table that has multiple uses for different times of the day. The uses of the table may include food prep, temporary storage for dirty dishes, or general tasks. The sorting apparatus may occupy some or all of this space while these other tasks are being completed. For this reason, it may be desirable to allow the user to utilize the top of the sorting apparatus to perform these tasks so that the sorting apparatus does not need to be moved. Moreover, if the top of the sorting apparatus is used for general tasks then the user may want to adjust the height of the sorting apparatus so that it is in a more ergonomic position for completing the general tasks.

However, in some embodiments, some of the users may want to move the sorting apparatus out of the way completely while the general tasks are performed. For this reason, it may desirable to have the sorting apparatus fold up and stored during times it is not in use.

There are embodiments in which the user may want to prepare the ware for tasks after the ware is clean. A number of dining establishments wrap their clean silverware in a napkin and then place the wrapped ware on a table for a customer; this is a common task that may need to be done. Typically, a user may first select the correct combination of ware and then stack the ware in a given order. For example, one might put a knife down first, followed by a fork on top of the knife and then a spoon on top of the fork. It would be beneficial to the user if the sorting apparatus were to complete such a stacking operation for the user so that they do not have to complete it while wrapping the ware.

SUMMARY

Embodiments of the disclosure create a more useable device for sorting, orienting, soaking, arranging and/or otherwise managing utensils while minimizing user input. The device must be simple enough for an unskilled employee to operate, accurately sort and orient a variety of utensils as well as stack and arrange them, operate efficiently and in a sanitary manner.

Further embodiments operate in such a way that the user can insert the utensils into an unsorted tray or bin. Moreover, the user should only have to transfer the bin or tray of sorted ware from the sorting station to the dishwasher, thus simplifying and optimizing the cleaning process. Also, an exemplary apparatus and an exemplary device can be used to arrange utensils for secondary operations such as wrapping, thus simplifying those processes as well. Furthermore, the device will be designed to work with existing equipment such as tables, shelving units, trays, etc.

Additional embodiments provide a means to determine if utensils have been inserted into an unsorted utensil area, such as a bin or tray. It also offers a device for locating where a utensil is, as well as a mechanism to pick up the utensil(s). The mechanism for picking up the utensil can transport the utensil so that another sub-system can identify and orient the utensil. Furthermore, the grasping mechanism(s) is also able to move the utensil(s) to a sorted area where they are also oriented in a specific direction; with one end of the longitudinal axes of each utensil aligned with each other. Moreover, the exemplary apparatus is capable of stacking and arranging the utensils. Also, the embodiments should be able to lift a utensil up to a specified weight regardless of the material composition.

Embodiments of the present disclosure include a method of managing one or more utensils. Such a method includes locating a utensil from an unsorted area using a utensil sorting device and coupling the utensil to a grasping mechanism of the utensil sorting device after being located. Further, the method includes identifying the utensil based on one or more physical characteristics of the utensil by the utensil sorting device and sorting the utensil into a sorted area based on identifying the utensil by the utensil sorting device. The physical characteristics of the utensils can include, but not limited to, weight, mass, width, length, depth, surface area, and optical characteristics. In addition, a magnet may be attached to the side of the grasping mechanism and/or an actuated magnet may be attached to the side of the grasping mechanism. Further, an extension plate extends from the grasping mechanism for moving ware from a side of a tray. In addition, the extension plate may extend from the grasping mechanism and the extension plate may include a magnet.

Moreover, the utensil sorting device includes a flat cover that allows for accessories. The accessories may include, but not limited to, walls, dividers, and cutting boards. Further, the utensil sorting device may include a stand. In addition, the stand includes one or more rotating main legs as well as the stand (in the same or different embodiment) includes one or more extendable stand legs extending from the main legs. Also, the one or more main legs of the stand are movable linearly.

Embodiments of the present disclosure also include a utensil sorting apparatus for managing one or more utensils. The apparatus include a plurality of arms configured to maneuvering linearly in at least one direction and configured to moving rotationally in at least one direction. The plurality of arms are further configured to transporting a first utensil from an unsorted area to a sorted area, for physically orienting the first utensil, and for stacking and arranging the first utensil. Further, the apparatus includes a locating mechanism to locate the first utensil in an unsorted area and a grasping mechanism capable of coupling and lifting the first utensil(s) as well as an identifying mechanism determining utensil type and orientation of the first utensil coupled to the grasping mechanism. In addition, the apparatus includes an inclined device to guide the ware to a vertical position. The inclined device may include one or more inclined surfaces and a channel to align stem of ware as well as one or more walls to prevent ware from rotating and a connector to attach the inclined device to the apparatus. Moreover, the inclined device may include one or more walls substantially parallel to the lengthwise side of ware such that the ware can be aligned against the one or more walls as well as one or more walls substantially perpendicular the lengthwise side of the ware such that the ware can be aligned against one or more walls. Such walls may be adjustable.

Further embodiments of the apparatus may include one or more ware trays having mating features to allow the one or more ware trays to be stacked securely. The mating features may include, but not limited to, bosses and grooves. Additional embodiments of the apparatus may include a display presenting information pertaining to operation of the apparatus. Moreover, the display may be an LCD, LED, or touchscreen. Further, the display may be adjustable.

BRIEF DESCRIPTION OF DRAWINGS

Exemplary embodiments of the present disclosure are described in more detail hereafter with the aid of the drawings, which show in.

DETAILED DESCRIPTION

Figure 1:
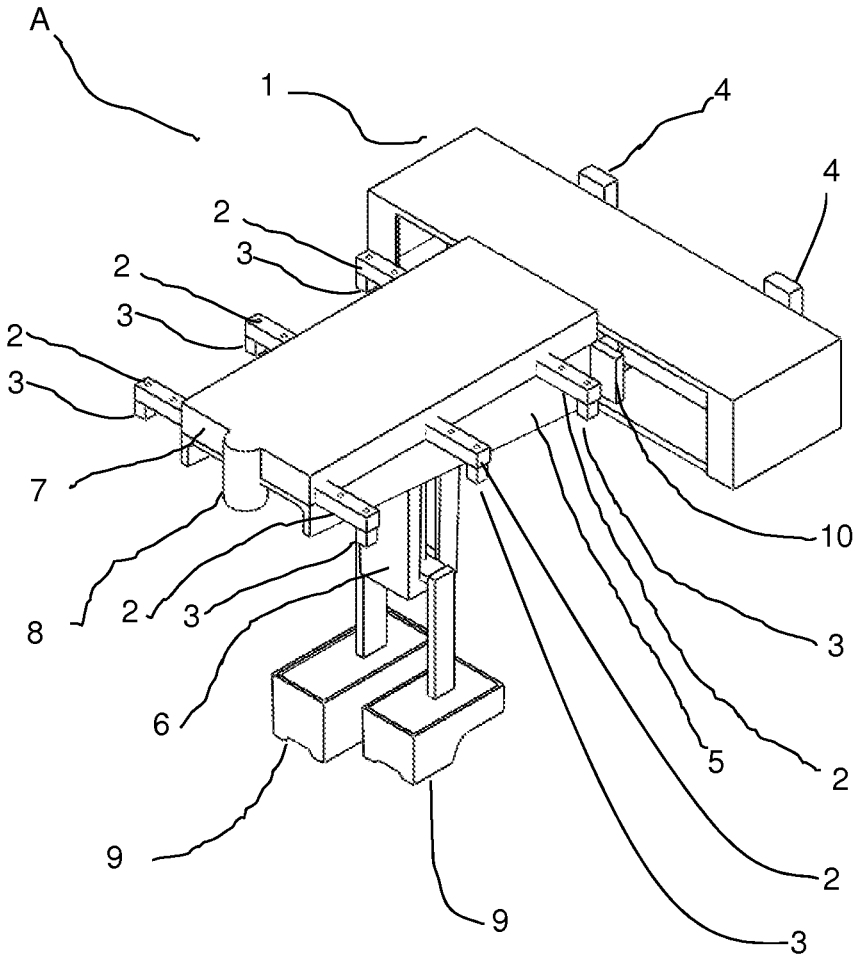
FIG. 1 is an isometric view of an exemplary utensil sorting apparatus.

In the following detailed description, reference is made to the accompanying drawings, which for a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of difference configurations, all of which are explicitly contemplated herein. Further, in the following description, numerous details are set forth to further describe and explain one or more embodiments. These details include system configurations, block module diagrams, flowcharts (including transaction diagrams), and accompanying written description. While these details are helpful to explain one or more embodiments of the disclosure, those skilled in the art will understand that these specific details are not required in order to practice the embodiments.

Referring to FIG. 1, an exemplary utensil sorting apparatus A for sorting, orienting, arranging, stacking and/or otherwise managing multiple utensils is shown. The utensil sorting apparatus A comprises of a plurality of arms, in this case an upper arm 5 and a lower arm 6. The arms are used to transport utensils so that they can be identified, oriented, arranged, and otherwise managed, accordingly. The arms are moved linearly and/or rotationally by a series of motors; the preferred type of motor is an induction motor because of its minimal noise output.

The upper arm 5 is attached to a base 1, which serves as a support structure for the apparatus. Further, the upper arm 5 is covered by the upper arm cover 7 for protection of the components. The upper arm cover 7 may be angled to aid in deflecting the utensils away from the upper arm 5 and into an unsorted area, such as a tray or bin. This may be necessary to ensure that the a user does not need to wait for the apparatus to move the arms out of the way of utensils being dropped or placed into the unsorted area.

Furthermore, the utensil supporting apparatus A has a locating mechanism 8 for detecting where a utensil is in a tray. The locating mechanism 8 can be attached to an arm, such as the upper arm 5, or to each grasping mechanism 9. The location may depend on how the arms move. If the arms are independent of each other, then the locating mechanism may be more effective attached to the grasping mechanisms 9. If the arms are dependent on each other, then the locating mechanism 8 may be more effective attached to the upper arm 5.

The locating mechanism 8 is preferred to be a non-contact sensor to increase the robustness of the utensil sorting apparatus A. Suitable non-contact sensors include proximity sensors, or metal detectors, but other known technologies in the art can be acceptable as well. Since most trays are plastic, a metal detector is a viable option. However, the metal detector may falsely locate a utensil if the utensil is on a metal table or shelf. For this reason, a proximity sensor is a preferred embodiment of the design because it can be made to detect an object at a specified distance.

Once an object has been detected a grasping mechanism 9 can move to that position and pick up a utensil. The utensil sorting apparatus A can then move the utensil into a position where it can be identified by the identifying mechanism 3, which is connected to the utensil sorting apparatus A by a holder 2. There are various means by which to identify and orient the utensil.

A preferred embodiment of the identifying mechanism 3 is to use or connect permanent magnet and a strain gauge to the holder 2. This will allow the holder 2 to act as a digital scale and based on the deflection of the holders 2 determine the type of utensil and orientation. Another preferred means is to use optical sensors, such as a series of beam break sensors, to determine the shape and orientation of the utensil. The optical sensors can be attached to an arm, such as the upper arm 5, or the grasping mechanism 9.

The identifying mechanism 3 serves two functions. A first function is to determine what type of utensil is attached to the grasping mechanism 9. The second function is to differentiate between the two ends of the longitudinal axis so that the ends of the longitudinal axes can be matched with the utensils already sorted, as well as with the ones yet to be sorted. This method of identifying and orienting is completed electronically. The plurality of arms, in the case shown the upper arm 5 and lower arm 6, can then physically orient the utensil by actuating rotationally using a motor, solenoid, or other technology in the art and place the utensil in a sorted area.

If necessary, the stop plate 10 can be used to aid in establishing the starting point for a scan to identify the utensil. The stop plate would serve as a fixed point where one end of the longitudinal axis of the utensil could be aligned against. Next, the utensil sorting apparatus A has a mounting mechanism 4 that allows it to be attached to a wall, table, bus bin cart, etc. This feature will allow for the utensil sorting apparatus A to be connected to a variety of objects found in a business where food is served. The mounting mechanism 4 can be a fastener set, quick clamp, magnet, hook, or other technology in the art.

The utensil sorting apparatus A may have more than one grasping mechanism 9 as well as a multitude of identifying mechanisms 3 in order to optimize the efficiency of the processes. Additionally, the plurality of arms can move independently or dependently depending on the need of the user for which it is designed.

Figure 2:
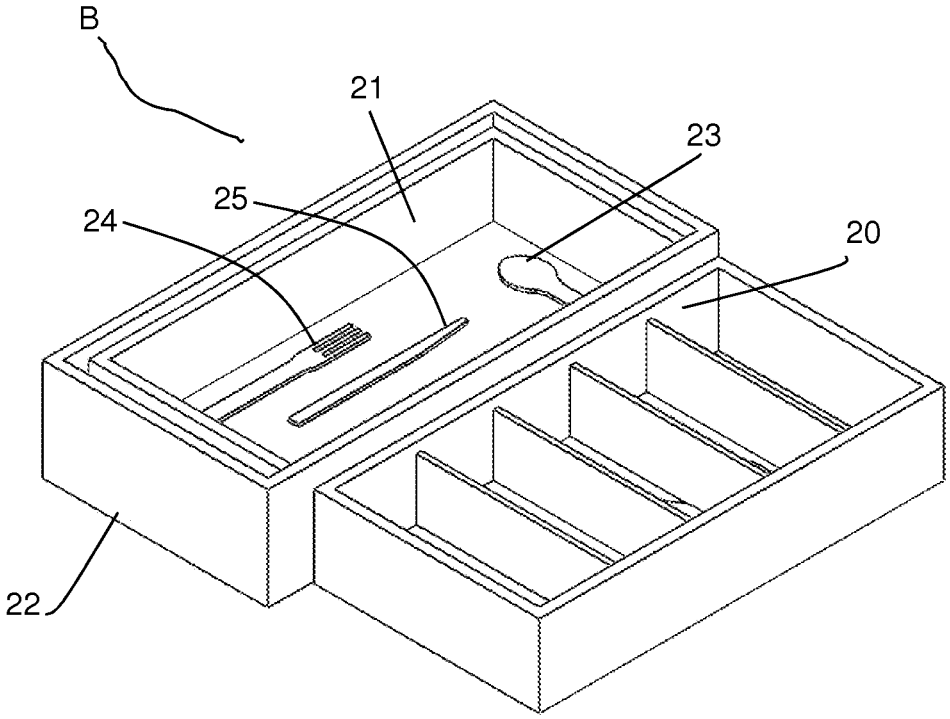
FIG. 2 is an isometric view of a tray with unsorted utensils next to a tray with sorted and oriented utensils lying on their side, as may be used with an embodiment of the present disclosure.

Additionally, the locating mechanism 8 may also be used to determine how full a sorted tray is, such as the sorted tray 20 shown in FIG. 2. This feature can be enabled to inform the user when a sorted tray of utensils is ready to be washed. The notification can be an audio cue such as a beep, visual cue such as a light, or other method known in the art.

FIG. 2 shows an unsorted tray 21 sitting in a soaking tub 22 wherein there are unsorted utensils; a spoon 23, fork 24, and knife 25; these are examples of some of the possible utensils that may be sorted with the apparatus. Additionally, there is a sorted tray 20 with a spoon 23, fork 24, and knife 25 next to the unsorted tray 21. This setup shows the start point and end point a potential sorting operation. Both the unsorted tray 21 and sorted tray 20 are examples of trays currently used in the restaurant industry; they represent one common example of equipment the utensil sorting apparatus A may have to integrate with.

Additionally, utensils such as a spoon 23, fork 24, and knife 25 can be stacked on top of each other. This can be done after the final cleaning and will allow the user to perform secondary operations, such as wrapping them in a napkin, more quickly.

Figure 3:
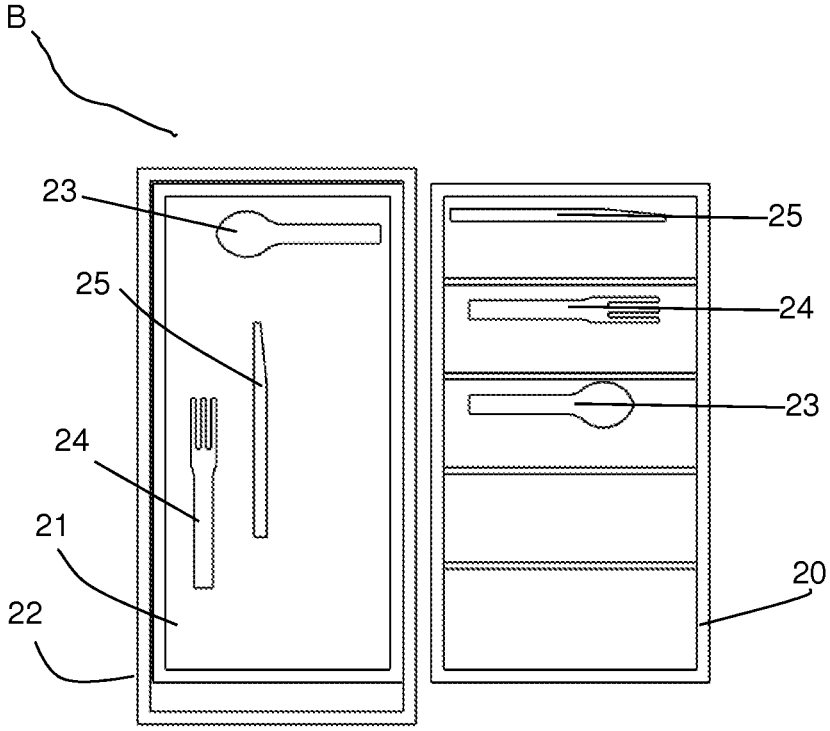
FIG. 3 is a top view of a tray with unsorted utensils next to a tray with sorted and oriented utensils lying on their side, as may be used with an embodiment of the present disclosure.

Moreover, in FIG. 3, there is the same unsorted tray 21 in a soaking tub 22 next to the sorted tray 20 showing what the utensils may look like in the sorted tray 20 after they have been sorted and oriented.

Figure 4:
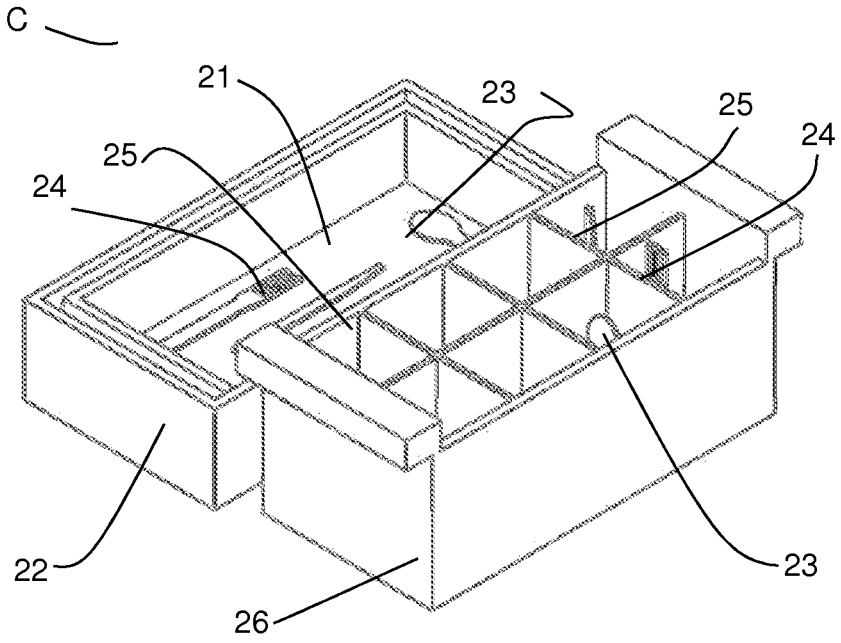
FIG. 4 is, an isometric view of a tray with unsorted utensils next to a tray with sorted and oriented utensils standing upright, as may be used with an embodiment of the present disclosure.

FIG. 4 shows another possible way that utensils, such as a spoon 23, fork 24, and knife 25, may be sorted and oriented after being removed from an unsorted tray 21 to a sorted tray 26. The sorted tray 26 represents a second common method by which utensils are currently sorted. The sorted tray 26 represents another method in which the utensil sorting apparatus A may be used.

Figure 5:
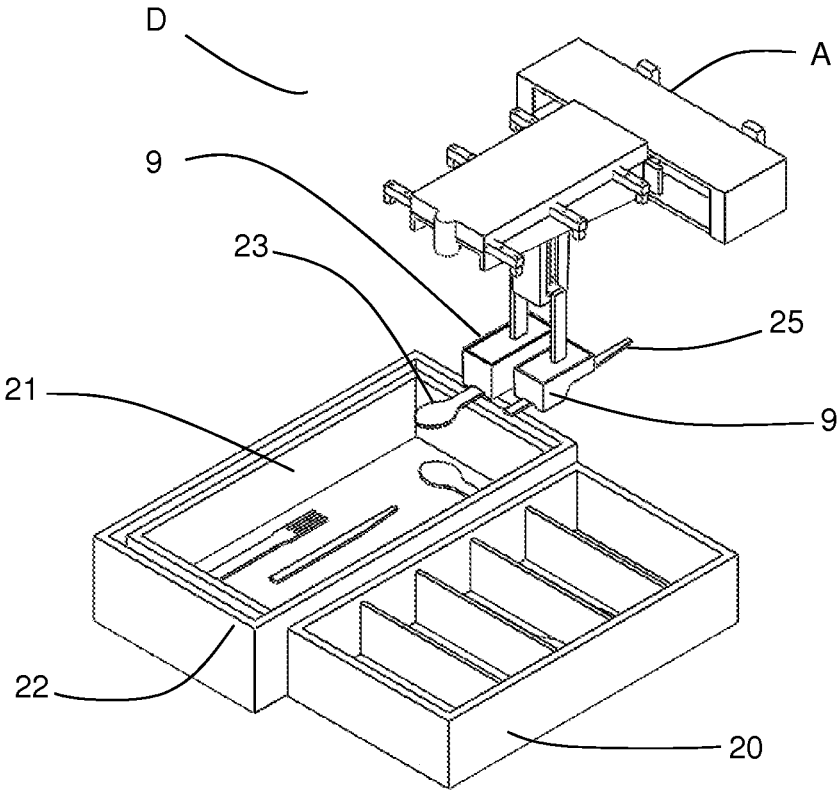
FIG. 5 is, an isometric view of an exemplary sorting apparatus moving utensils from an unsorted area to an area where the utensils are sorted and oriented.

FIG. 5 shows the utensil sorting apparatus A in the process of identifying and orienting two utensils, a spoon 23 and knife 25 that were removed from the unsorted tray 21. The utensils, a spoon 23 and knife 25 will be placed in a sorted tray 20 after they have been identified and oriented as previously described. The utensils are sorted by moving the grasping mechanism 9 close to the identifying mechanism 3. In different embodiments, the identifying mechanism 3 can use the physical characteristics (e.g. weight, mass, width, length, depth, surface area, optical characteristics, etc.) to identify the type of utensil (e.g. fork, spoon, knife, etc.). In one embodiment, the identifying mechanism 3 can be a magnet attached to a digital scale. In such an embodiment, the digital scale may read different values for a utensil depending on which part of the utensil is near the magnet. The read values can be compared to previous or preset values stored in a computer memory by a computing device with a process coupled to the apparatus. Further, the apparatus can then rotate the arms such that the similar values are all at one side of a sorted tray.

In another embodiment, the identifying mechanism 3 can be an optical sensor. Such an optical sensor can detect the relative height of a surface on a utensil. It can also be used to detect the concavity of a utensil. Moreover, it can be used to detect the number of times a beam is broken; for example, a fork would have multiple breaks, where as spoon would only have one. The apparatus would also correlate the time between breaks to determine the width of a utensil. The optical sensor may be used in conjunction with a light source coupled to the apparatus to provide a beam for the optical sensor to detect beam breaks and a computing device coupled to the apparatus to analyze data provided by an optical sensor (directly or indirectly through an electro-optical device) to determine the type of utensil.

Figure 6:
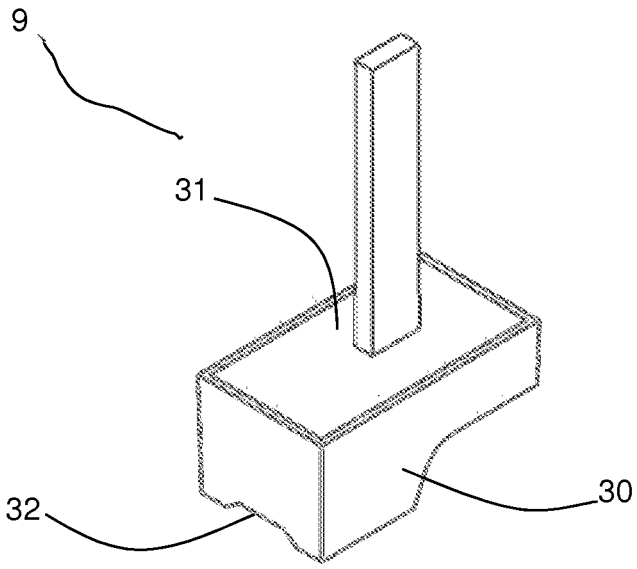
FIG. 6 is an isometric view of an exemplary grasping mechanism.

FIG. 6 shows the outside of the grasping mechanism 9. The grasping mechanism 9 consists of a housing 30, a housing cover 31, and a channel 32. The channel 32 is to help guide the utensil toward the center of the grasping mechanism 9 such that the longitudinal axis of the utensil is in line with the channel 32. The purpose of this action is to align the longitudinal axis of the utensil with the lifting element 34 of the grasping mechanism 9 and the identifying mechanism 8.

Figure 7:
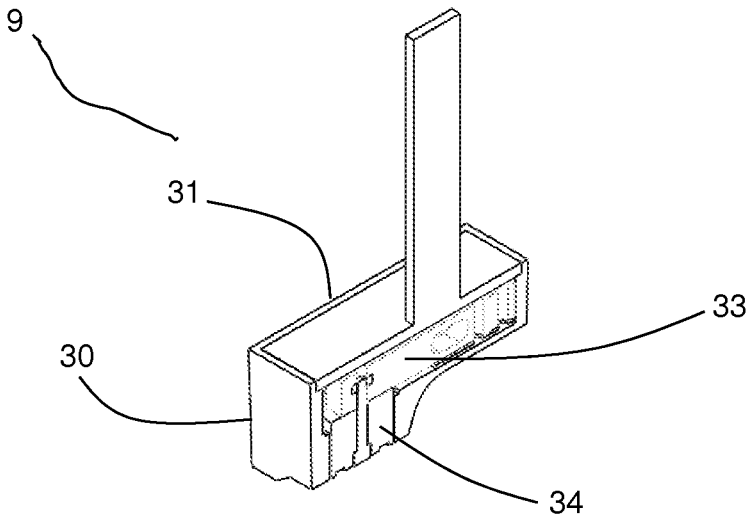
FIG. 7 is, a cross section isometric view showing an exemplary set of components of the grasping mechanism.

FIG. 7 is a cross section isometric view of the grasping mechanism 9 to show the lifting element 34 and the lifting element holder 33. As shown, the lifting element 34 is an electromagnet; an electromagnet was chosen because a large portion of utensils are magnetic and this provides a non-contact solution while minimizing the number of moving parts. However, a permanent magnet in conjunction with a motor, solenoid, or stationary plate could also be used when utensils are magnetic. In the event that the utensils are not magnetic a suction device actuated by a motor or solenoid may be employed. Furthermore, other technologies in the art may prove to be acceptable designs as well.

Additionally, the grasping mechanism 9 may have a device connected to it to notify the utensil sorting apparatus A has picked up a utensil. In the case shown, the lifting element holder 33 has a strain gauge connected to it; this serves as a digital scale. Once the strain gauge detects a change in deflection the utensil sorting apparatus knows to move the grasping mechanism 9 to the identification mechanism 3. This design also allows the utensil sorting apparatus A to initially identify the utensil based on its weight before the utensil nears the identification mechanism 3, thus optimizing the efficiency of the identification process. However, other methods, such as an optical beam break, proximity sensor, or other know technology in the art could be used to notify the utensil sorting apparatus A when the grasping mechanism 9 has picked up a utensil. Other methods may not allow the utensil sorting apparatus A to initially identify a utensil.

Figure 8:
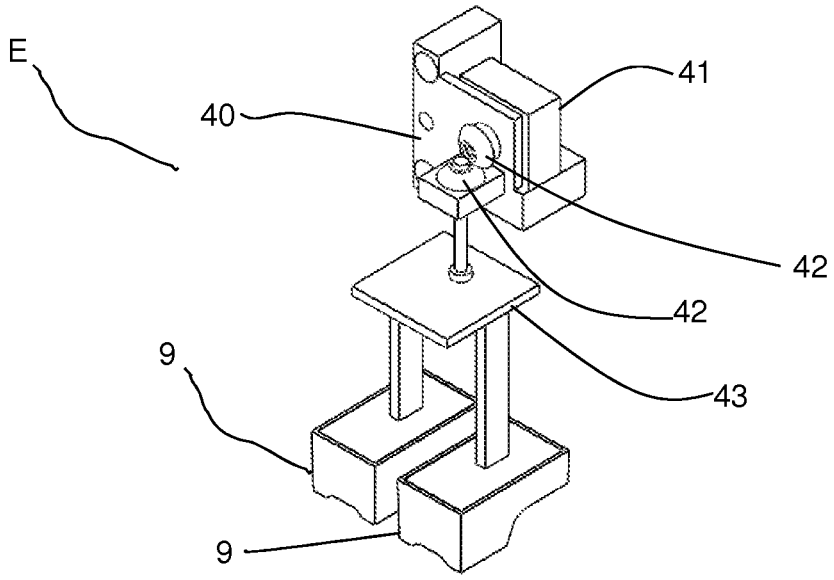
FIG. 8 is an isometric view showing an exemplary carriage and an exemplary set of rotational components for moving a utensil(s).

FIG. 8 shows a lower arm carriage E consisting of a carriage 40, a motor 41 mounted to the carriage 40, miter gears 42, and a secondary lower arm 43, and two grasping mechanisms 9. The lower arm carriage E allows the utensil sorting apparatus A to physically sort and orient a utensil as shown in FIG. 2 and FIG. 3. The motor 41 actuates the lower arm 43 so that the utensils, such as a spoon or fork, can have the ends of their longitudinal axis matched with those of the utensils that are already sorted. The longitudinal ends are matched as previously described with use of a digital scale and magnet, or an optical sensor.

Figure 9:
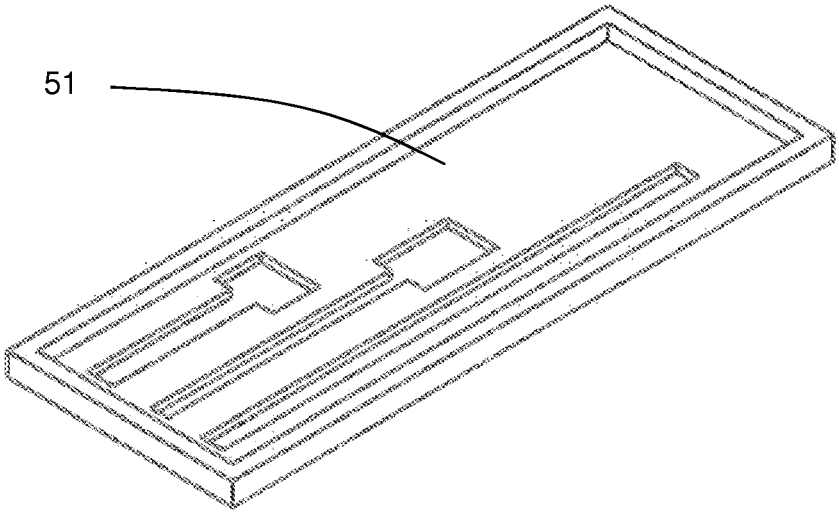
FIG. 9 is an isometric view of an exemplary configuration of an aperture for aiding in the orientation and identification of a utensil.

Referring to FIG. 9, an example of an aperture plate 51 for aiding in the orientation and identification of a utensil is shown. This aperture plate 51 can be mounted to the utensil sorting apparatus A. The aperture plate 51 could serve as physical way to determine the orientation of the longitudinal axis of a utensil. This feature could serve as a check for other methods already mentioned.

Figure 10:
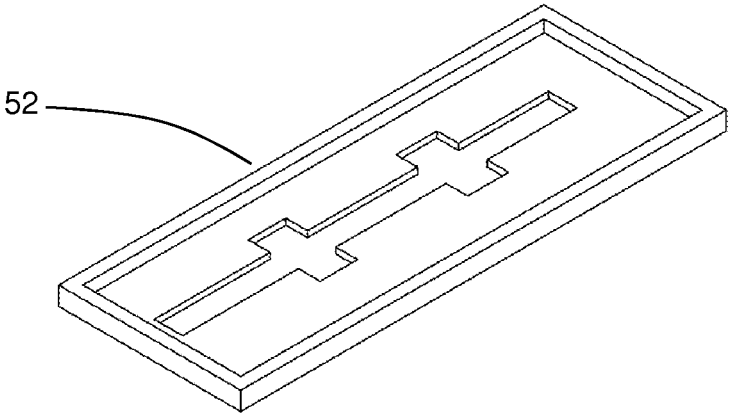
FIG. 10 is an isometric view of another exemplary configuration of an aperture for aiding in the orientation and identification of a utensil.

In FIG. 10 there is another example of an aperture plate 52 for aiding in the orientation and identification of a utensil shown. This aperture plate 52 can be mounted to the utensil sorting apparatus A. The aperture plate 52 has the same function as the previously mentioned aperture plate 51, but may be a more a viable design based on economic and special constraints.

Figure 11:
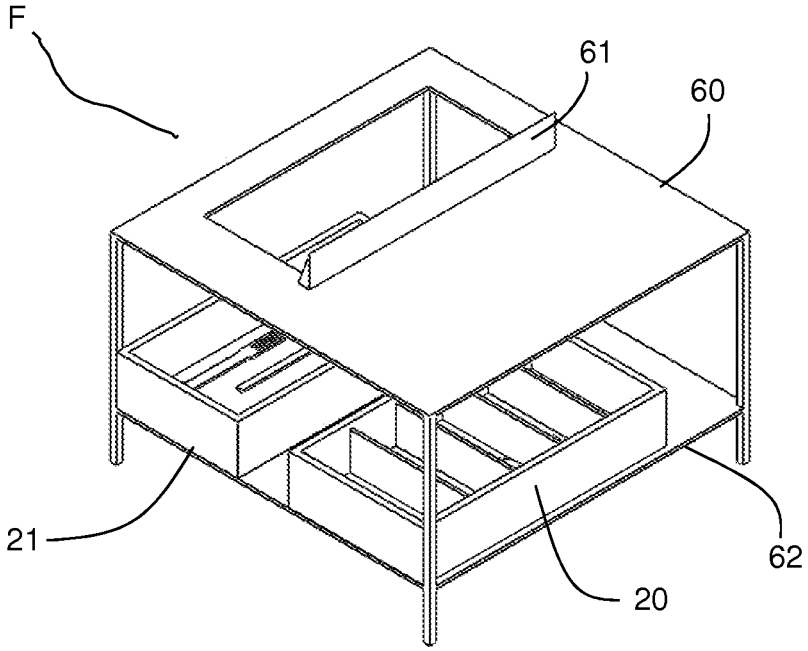
FIG. 11 is an isometric view of an exemplary stand that an exemplary utensil sorting apparatus may be attached to with a tray of unsorted utensils and a tray of sorted and oriented utensils.

Next, in FIG. 11, a stand F is shown. The stand F consists of one more shelves; in this case an upper shelf 60 and a lower shelf 62. The shelves may have a guide feature 61 that forces any utensils dropped toward the slot into an unsorted area, such as a tray or bin. The utensil sorting apparatus A may be connected to the stand F. The purpose of the stand F is to allow a more efficient integration of the utensil sorting apparatus A with existing equipment.

Figure 12:
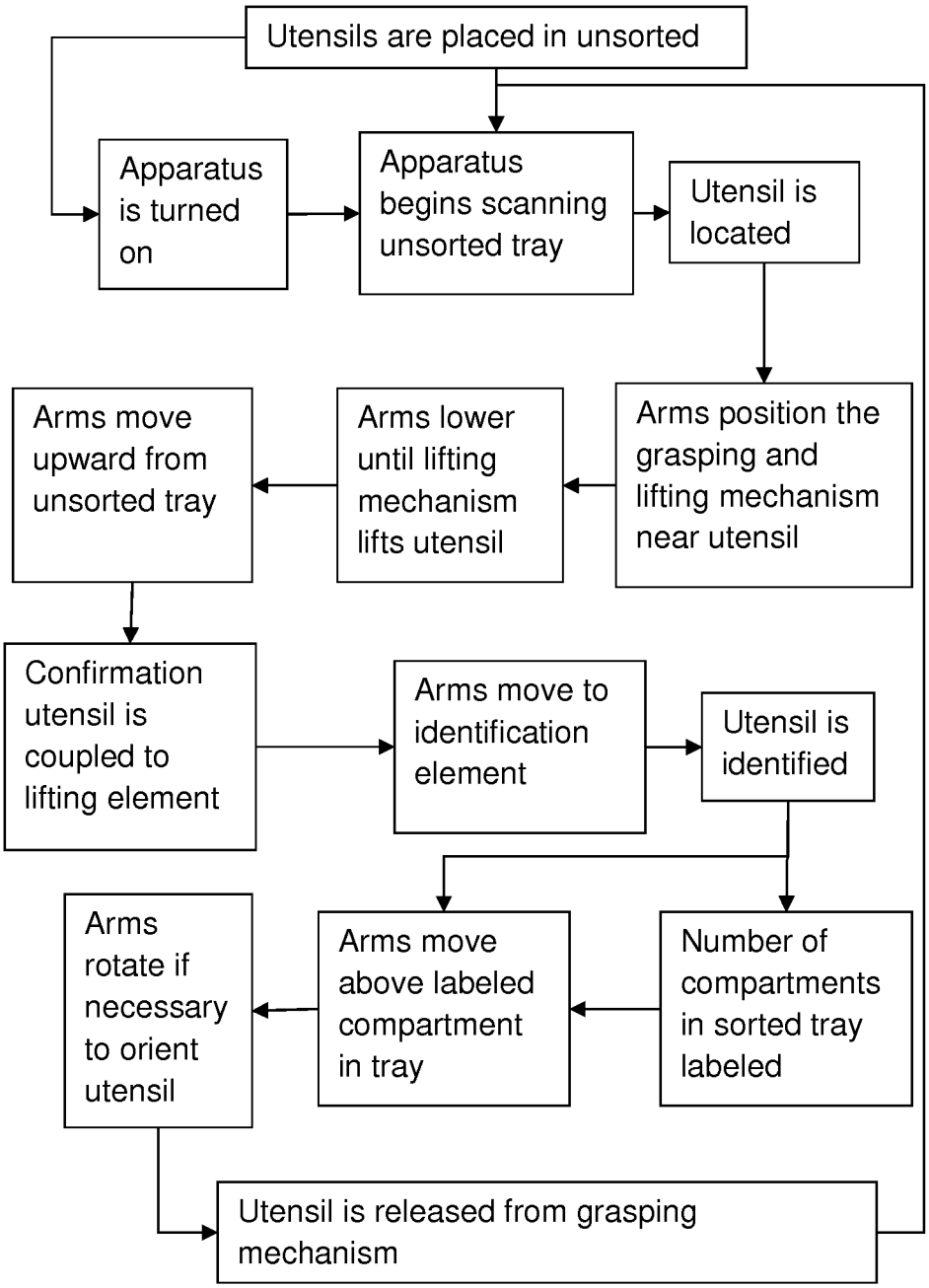
FIG. 12 is an exemplary flow chart showing an exemplary method for sorting utensils.

In FIG. 12 an exemplary flow chart describes an exemplary method by which a utensil is sorted and oriented. The utensils can be added to the unsorted tray at any point in the process. A device implementing the exemplary method can lift a utensil so that it can sort, orient, and manage a device.

Figure 13:
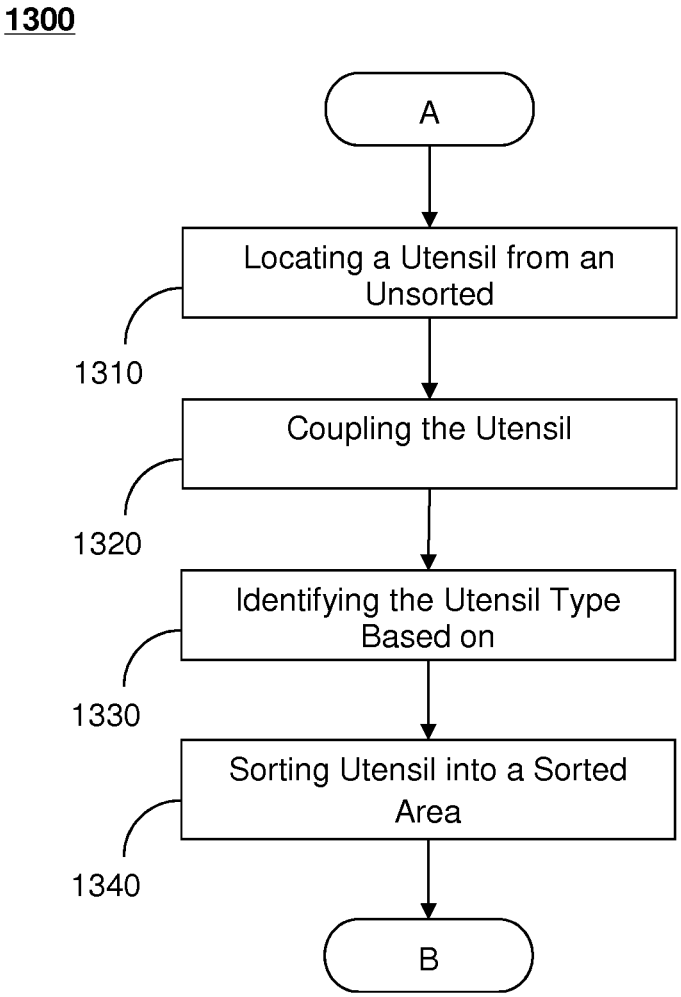
FIG. 13 is another exemplary flowchart showing an exemplary method for sorting utensils.

FIG. 13 is another exemplary flowchart 1300 showing an exemplary method for sorting utensils. The exemplary method may be implemented by a utensil sorting apparatus as described in the present disclosure. A first step in the exemplary method may be locating a utensil from an unsorted area, as shown in block 1310. The location of the utensil may be determined by a locating mechanism of the utensil sorting apparatus. The locating mechanism is preferred to be a non-contact sensor to increase the robustness of the utensil sorting apparatus A. Suitable non-contact sensors include proximity sensors, or metal detectors, but other known technologies in the art can be acceptable as well. The unsorted area may be a tray of unsorted utensils. A further step in the exemplary method may be coupling the utensil after being located, as shown in block 1320. The coupling may be implemented by a grasping mechanism of the apparatus as described in the present disclosure. An additional step in the exemplary method may be identifying the utensil based on the utensil's physical characteristics, as shown in block 1330. Identifying the utensil may be done by an identifying mechanism of the apparatus as described in the present disclosure. For example, the identifying mechanism can use the physical characteristics (e.g. weight, mass, width, length, depth, surface area, optical characteristics, etc.) to identify the type of utensil (e.g. fork, spoon, knife, etc.). The identifying mechanism may be a magnet in combination with a digital scale to determine the weight of the utensil. Another identifying mechanism may be an optical sensor that detects the optical characteristics or beam breaks of the utensil. The exemplary method may also include a step of sorting the utensil into a sorted area, as shown in block 1340. The sort area may be a sorted utensil tray.

Figure 14:
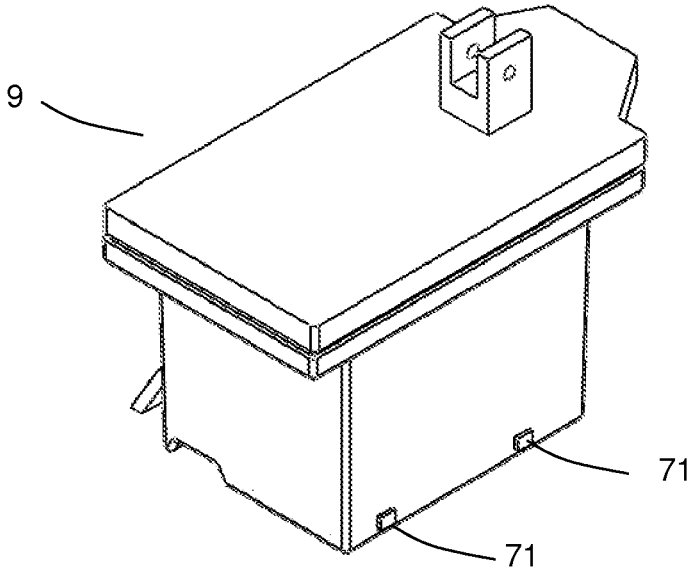
FIG. 14 shows an isometric view of the grasping mechanism with magnets protruding from the side for aiding in pulling ware from the side of the unsorted tray so that the grasping mechanism can pick it up.

FIG. 14 shows a grasping mechanism 9 with magnets 71 protruding from the side. In some embodiments, the ware may be pushed up against the side wall of a tray containing unsorted ware. In such embodiments, the coupling mechanism in the grasping mechanism may not be able to correctly engage the ware because of the ware is resting in an unconventional position (e.g. on its side). The magnets allow the ware to be pulled from the side of the tray and placed into a more conventional position (e.g. resting in a flat position) such that the coupling mechanism can properly engage the ware.

Figure 15:
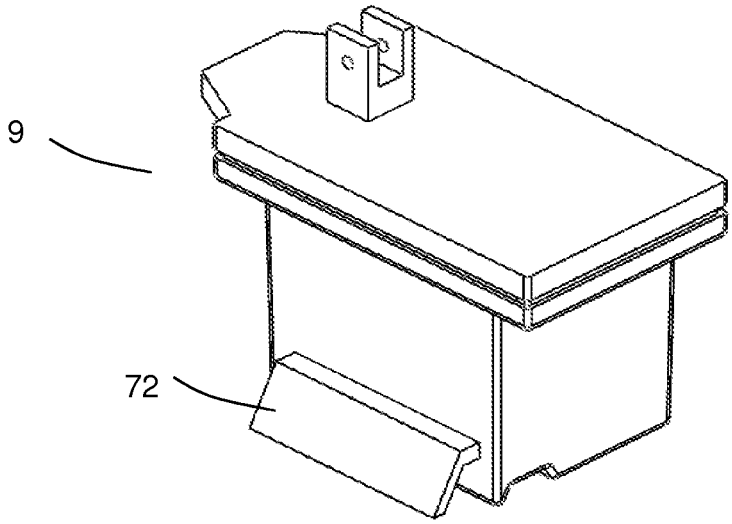
FIG. 15 shows an isometric view of the grasping mechanism with a plate extending from the side of it for aiding in pulling ware away from the side of the unsorted tray so that the grasping mechanism can pick it up.

FIG. 15 shows a grasping mechanism 9 with a plate 72 protruding from the side. The plate serves the same function as the magnets that are shown in FIG. 14. That is, the plate 72 allows the ware resting in an unconventional position to be pulled from the side of the tray and placed in a more conventional position such that the coupling mechanism can properly engage the ware.

Figure 16:
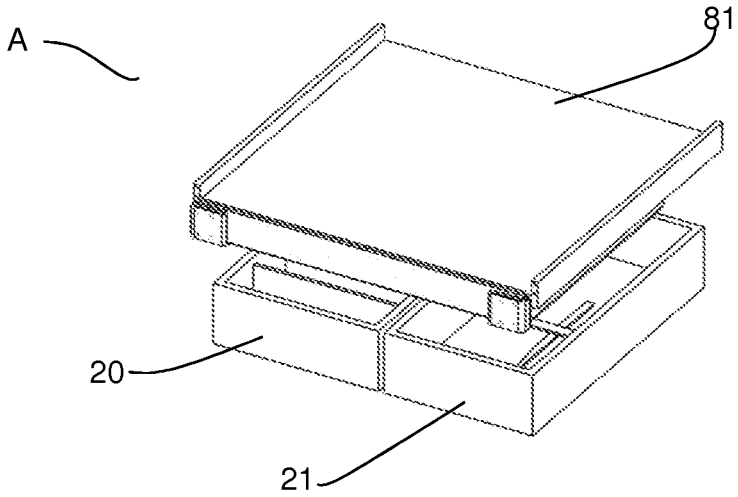
FIG. 16 shows an isometric view of the apparatus with a working surface attached to the top of it.
Figure 17:
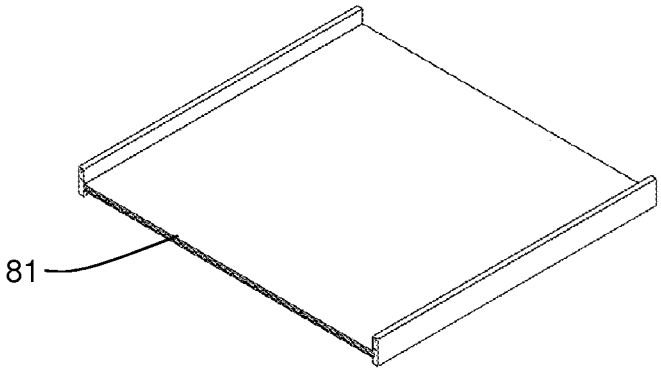
FIG. 17 shows an isometric view of a working surface that is flat.
Figure 18:
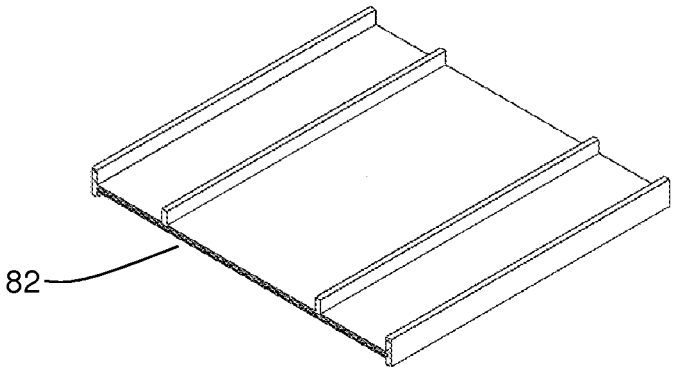
FIG. 18 shows an isometric view of a working surface that is has dividers.

FIG. 16 shows the sorting apparatus A relative to the unsorted tray 21 (i.e. unsorted ware in a tray) and the sorted tray 20 (i.e. sorted ware in a tray). On top of the apparatus A is a flat working surface 81. An example of flat working surface is also shown in FIG. 17 while FIG. 18 shows the working surface with dividers 82. Such a working surface (81 and 82) allows the sorting apparatus A to be setup on a table that has multiple uses for different times of the day. The uses of the table may include food prep, temporary storage for dirty dishes, or general tasks. The sorting apparatus may occupy some or all of this space while these other tasks are being completed. For this reason, it may be desirable to allow the user to utilize the top of the sorting apparatus having the working surfaces (81 and 82) to perform these tasks so that the sorting apparatus does not need to be moved.

Figure 19:
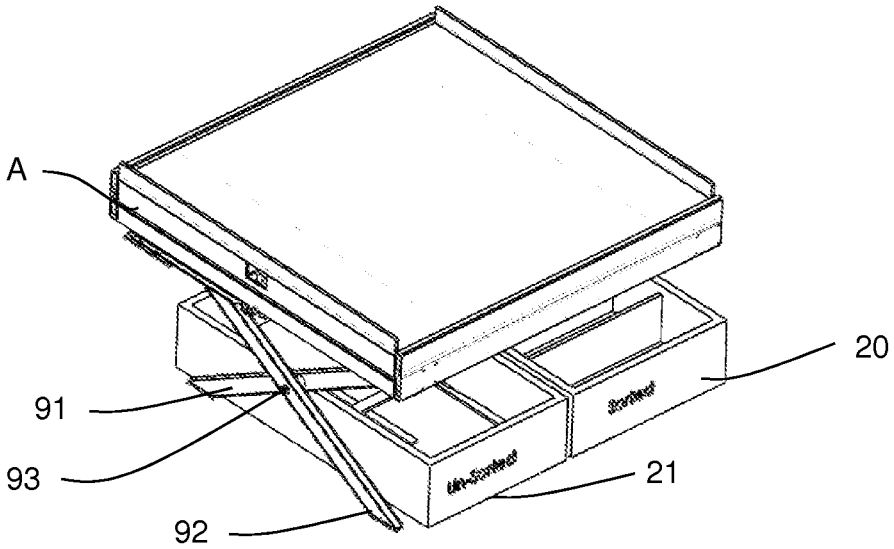
FIG. 19 shows an isometric view of the apparatus with a pair of extendable legs attached to it and in the extended position.

FIG. 19 shows the sorting apparatus A relative to the unsorted tray 21 and the sorted tray 20. Attached to the apparatus is stand. The stand elements shown in FIG. 19 include a first leg 91, a second leg 92, and a connection mechanism 93 (e.g. a nut and bolt connector or any other connecting mechanism known in the art) to hold the legs (91 and 92) together.

Figure 20:
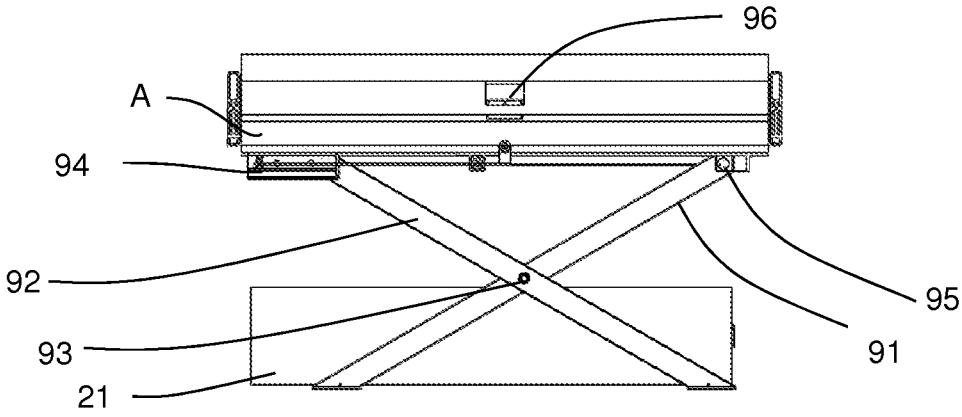
FIG. 20 shows a profile view of the apparatus with a pair of extendable legs attached to it and in the extended position.

FIG. 20 further shows a stand by showing the apparatus A, the unsorted tray 21 with the first leg 91, a second leg 92, a connection mechanism 93 to hold the legs (91 and 92) together, as well as the lever 96 to allow the legs to move. Also shown are the connection mechanisms 94 and 95 that connect the stand to the apparatus A.

Figure 21:
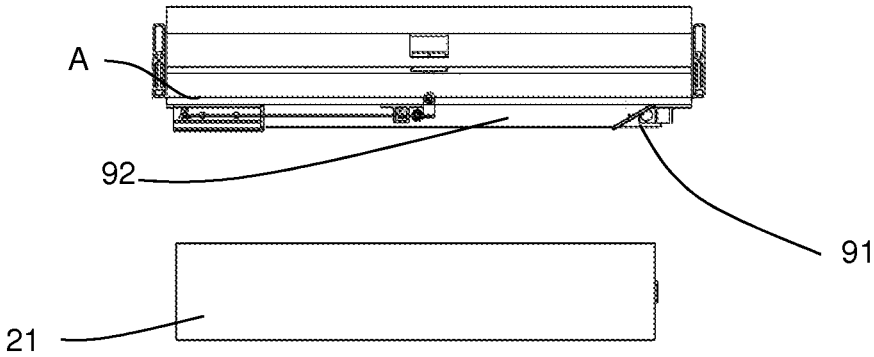
FIG. 21 shows a profile view of the apparatus with a pair of extendable legs attached to it and in the retracted position.

FIG. 21 shows the apparatus A attached to the stand with the first leg 91 and second leg 92 in the closed position. FIG. 19, FIG. 20, and FIG. 21 show one example of a stand that releases on rotation to open and close the legs. Another embodiment may include the legs slide out in a linear fashion. In embodiments that include a working surface on the top of the sorting apparatus to be used to perform general tasks then the user may want to adjust the height of the sorting apparatus so that it is in a more ergonomic position for completing the general tasks using the stand and the legs (91 and 92).

Figure 22:
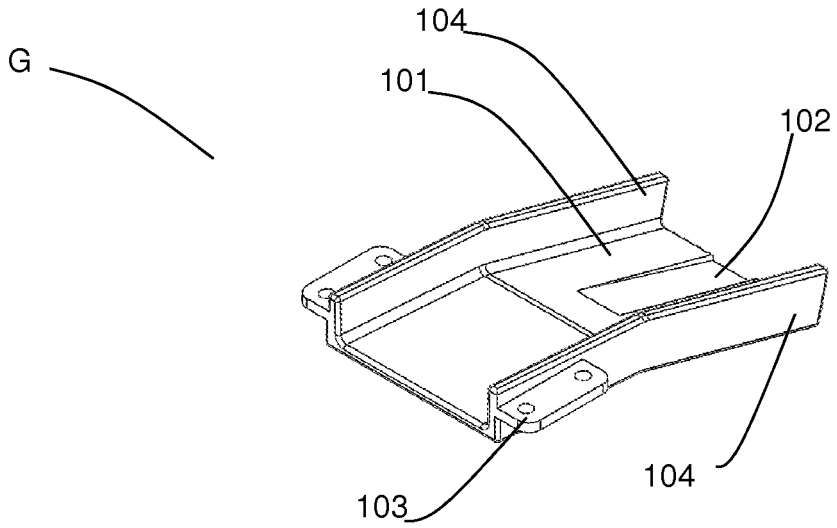
FIG. 22 shows an isometric view of an alignment ramp that can be used to position ware in the vertical position.

FIG. 22 shows an alignment ramp G used to assist in sorting ware using a sorting apparatus comprising of a primary inclined surface 101, a secondary inclined surface 102, side walls 104, and an attachment interface 103. The primary inclined surface 101 guides a whole piece of ware while the secondary inclined surface 102 guides the stem of the ware. The side walls 104 prevent the ware from twisting too much as they move down the alignment ramp G. The attachment interface 103 allows for the alignment ramp to attach to the main apparatus A.

Figure 23:
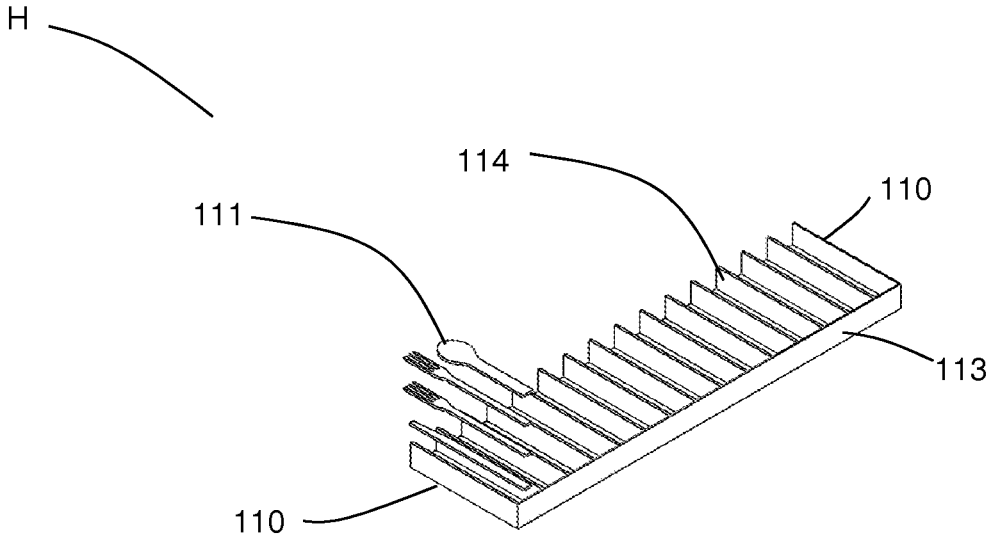
FIG. 23 is an isometric view of a tray for aligning and organizing ware for wrapping.

FIG. 23 shows a tray for holding ware H that may be used in conjunction with a sorting apparatus to sort ware. The tray H consists of side walls 110, a perpendicular wall 113, and dividers 114 for the stacks of ware 111. The side walls 110 and perpendicular walls 113 are used to orient the ware the correct position. They may be adjustable and may hold the ware tightly or loosely.

Figure 24:
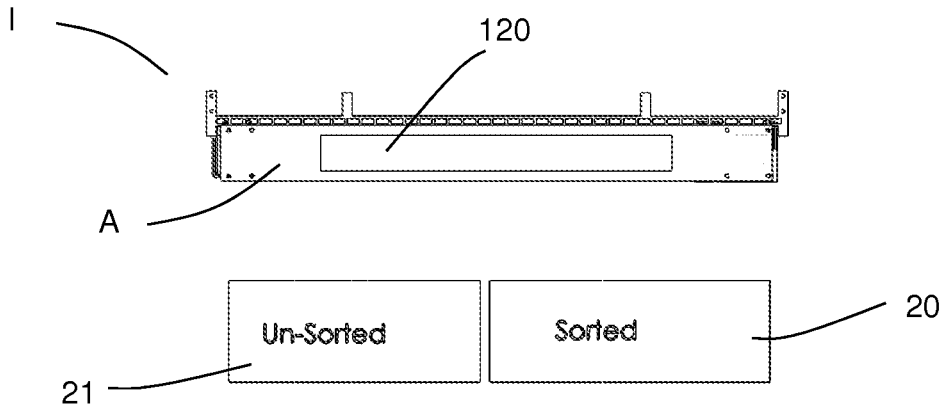
FIG. 24 is a front view of the apparatus with a screen for viewing information.

FIG. 24 shows a front view of the apparatus I with a display screen 120 relative to the unsorted tray 21 and sorted tray 20. The display screen 120 can display information such as how much ware has been accounted, when alert signals should sound to indicate it is time to change the trays, etc.

Note that the functional blocks, methods, devices and systems described in the present disclosure may be integrated or divided into different combination of systems, devices, and functional blocks as would be known to those skilled in the art. Further, each Figure may show a different embodiment of the disclosure even though the same reference numerals, letters, or indicators are used.

In general, it should be understood that the circuits described herein may be implemented in hardware using integrated circuit development technologies, or yet via some other methods, or the combination of hardware and software objects that could be ordered, parameterized, and connected in a software environment to implement different functions described herein. For example, the present application may be implemented using a general purpose or dedicated processor running a software application through volatile or non-volatile memory. Also, the hardware objects could communicate using electrical signals, with states of the signals representing different data.

It should be further understood that this and other arrangements described herein are for purposes of example only. As such, those skilled in the art will appreciate that other arrangements and other elements (e.g. machines, interfaces, functions, orders, and groupings of functions, etc.) can be used instead, and some elements may be omitted altogether according to the desired results. Further, many of the elements that are described are functional entities that may be implemented as discrete or distributed components or in conjunction with other components, in any suitable combination and location.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions, or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

I claim:

1. A method of managing one or more utensils, the method comprising:

(a) locating a utensil from an unsorted area using a utensil sorting device;

(b) coupling the utensil to a grasping mechanism of the utensil sorting device after being located;

(c) identifying the utensil based on one or more physical characteristics of the utensil by the utensil sorting device;

(d) sorting the utensil into a sorted area based on identifying the utensil by the utensil sorting device;

(e) a stand that includes one or more rotating main legs and one or more extendable stand legs extending from the one or more rotating main legs.

2. The method of claim 1, wherein the physical characteristics of the utensils is selected from the group consisting of weight, mass, width, length, depth, surface area, and optical characteristics.

3. The method of claim 1 wherein a magnet is attached to the side of the grasping mechanism.

4. The method of claim 1 wherein an actuated magnet is attached to the side of the grasping mechanism.

5. The method of claim 1 wherein an extension plate extends from the grasping mechanism for moving ware from a side of a tray.

6. The method of claim 1 wherein an extension plate extends from the grasping mechanism, the extension plate including a magnet.

7. The method of claim 1, wherein the utensil sorting device includes a flat cover that allows for accessories, the accessories selected from the group consisting of walls, dividers, and cutting boards.

8. The method of claim 1, wherein the one or more main legs of the stand are movable linearly.

9. A utensil sorting apparatus for managing one or more utensils, the apparatus comprising:

a plurality of arms configured to maneuvering linearly in at least one direction and configured to moving rotationally in at least one direction such that the plurality of arms are further configured to:

transporting a first utensil from an unsorted area to a sorted area;

for physically orienting the first utensil;

for stacking and arranging the first utensil;

a locating mechanism to locate the first utensil in an unsorted area a grasping mechanism capable of coupling and lifting the first utensil(s)

an identifying mechanism determining utensil type and orientation of the first utensil coupled to the grasping mechanism an inclined device to guide the ware to a vertical position, the inclined device including:

one or more inclined surfaces;

a channel to align stem of ware;

one or more walls to prevent ware from rotating;

a connector to attach the inclined device to the apparatus.

10. The apparatus of claim 9 wherein the inclined device further includes:

one or more walls substantially parallel to the lengthwise side of ware such that the ware can be aligned against the one or more walls;

one or more walls substantially perpendicular the lengthwise side of the ware such that the ware can be aligned against one or more walls.

11. The apparatus of claim 10 wherein the walls are adjustable.

12. The apparatus of claim 10 further comprises one or more ware trays having mating features to allow the one or more ware trays to be stacked securely wherein the mating features is selected from the group consisting of bosses and grooves.

13. The apparatus of claim 9, further comprising a display presenting information pertaining to operation of the apparatus.

14. The apparatus of claim 13, wherein the display is selected from the group consisting of an LCD, LED, and touchscreen.

15. The apparatus of the claim 13, wherein the display is adjustable.

* * * * *